US007838820B2

(12) United States Patent
Verbeck et al.

(10) Patent No.: US 7,838,820 B2
(45) Date of Patent: Nov. 23, 2010

(54) CONTROLLED KINETIC ENERGY ION SOURCE FOR MINIATURE ION TRAP AND RELATED SPECTROSCOPY SYSTEM AND METHOD

(75) Inventors: Guido F. Verbeck, Knoxville, TN (US); William B. Whitten, Oak Ridge, TN (US); Jeremy Moxom, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 347 days.

(21) Appl. No.: 11/145,699

(22) Filed: Jun. 6, 2005

(65) Prior Publication Data

US 2006/0273251 A1 Dec. 7, 2006

(51) Int. Cl.
*H01J 49/00* (2006.01)

(52) U.S. Cl. ..... 250/281; 250/283; 250/290; 250/292

(58) Field of Classification Search ..... 250/281
See application file for complete search history.

(56) References Cited

U.S. PATENT DOCUMENTS

| | | | | |
|---|---|---|---|---|
| 6,124,592 | A * | 9/2000 | Spangler | 250/287 |
| 6,323,482 | B1 | 11/2001 | Clemmer et al. | |
| 6,429,298 | B1 | 8/2002 | Ellington et al. | |
| 6,504,149 | B2 | 1/2003 | Guevremont et al. | |
| 6,597,487 | B2 | 7/2003 | Hutchinson et al. | |
| 6,690,004 | B2 * | 2/2004 | Miller et al. | 250/286 |
| 6,750,448 | B2 * | 6/2004 | Turecek et al. | 250/281 |
| 6,794,641 | B2 * | 9/2004 | Bateman et al. | 250/281 |
| 6,870,158 | B1 * | 3/2005 | Blain | 250/292 |
| 6,933,498 | B1 | 8/2005 | Whitten et al. | |
| 7,155,812 | B1 * | 1/2007 | Peterson et al. | 29/610.1 |
| 2005/0056780 | A1 * | 3/2005 | Miller et al. | 250/288 |
| 2005/0145789 | A1 * | 7/2005 | Miller et al. | 250/290 |

OTHER PUBLICATIONS

Seaver, A.E., "Mobility and High Electric Fields", IEEE Trans. Indus. App. 1997, vol. 33, No. 3, pp. 687-691.

(Continued)

*Primary Examiner*—David A. Vanore
*Assistant Examiner*—Phillip A. Johnston
(74) *Attorney, Agent, or Firm*—Novak Druce + Quigg LLP; Gregory A. Nelson; Gregory M. Lefkowitz

(57) ABSTRACT

An ion trap mass spectrometry system adapted for portability and related method includes an ion source for generating ions from a sample to be analyzed, and a resistive drift tube coupled to an output of the ion source for receiving the ions injected therein. The resistive drift tube decelerates the ions to provide cooled ions having a mean translational kinetic energy of less than 5 keV. A miniature ion trap or trap array, such having apertures <1 mm, is coupled to an output of the resistive drift tube for trapping the cooled ions. A spectrometer is coupled to the miniature ion trap for analyzing the cooled ions.

16 Claims, 5 Drawing Sheets

OTHER PUBLICATIONS

Asbury, G.R. et al. "Using Different Drift Gases to Change Separation Factors (alpha) in Ion Mobility Spectrometry", Anal. Chem. 2000, vol. 72, pp. 580-584.

Wyttenbach, T. et al. "Effect of the Long-Range Potential on Ion Mobility Measurements", J. Am. Soc. Mass Spectrom., 1997, vol. 8, pp. 275-282.

Tammet, H. J., "Size and Mobility of Nanometer Particles, Clusters and Ions", Aerosol Sci., 1995, vol. 26, No. 3, pp. 459-475.

McDaniel, E.W. "Collision Phenomena in Ionized Gases", John Wiley & Sons, New York, N.Y. 1964, pp. 426-441.

Chapman, S. et al. "The Mathematical Theory of Non-Uniform Gases" Cambridge, London, 1960, pp. 200-217.

Mrotek, S. et al. "The Development of Novel Resistive Glass Technology to Simplify Designs in Analytical Instruments", May 2004 American Society of Mass Spectroscopy Conf.

* cited by examiner

CONTROLLED KINETIC ENERGY ION SOURCE FOR MINIATURE ION TRAP AND RELATED SPECTROSCOPY SYSTEM AND METHOD

STATEMENT REGARDING FEDERALLY SPONSORED RESEARCH OR DEVELOPMENT

The United States Government has rights in this invention pursuant to DARPA Contract No. 1868-HH-61-X1.

CROSS REFERENCE TO RELATED APPLICATIONS

Not applicable.

BACKGROUND OF THE INVENTION

1. Technical Field

This invention relates to ion sources, and more particularly to controlled kinetic energy ion sources coupled to miniature ion traps or ion trap arrays, and spectroscopy systems based thereon.

2. Description of the Related Art

Time-of-flight (TOF) mass spectrometry is an analytical technique that is widely used because of its simplicity and wide mass range. In an idealized TOF system, ions are initially confined to a small spatial region and are nearly at rest near an electrode. However, in real TOF-based systems, the ions are initially neither nearly at rest nor in a well defined spatial region.

At certain discrete times, generally denoted as t=0, the ions are accelerated by an applied electric field imposed between an acceleration grid and an electrode sheet where the ions initially reside. The ions are then allowed to drift in a zero field region located between the acceleration grid and a detector until they reach the detector. The arrival time of the ions can be related to their mass because the heavier ions achieve a lower velocity while in the acceleration zone as compared to lighter ions. Thus, the method requires that the ions be pulsed in time or in a beam that is chopped at high frequency. There are many configurations of time-of-flight mass spectrometers. For example, some use reflection of the ions in an attempt to compensate for different initial velocities at the start of the acceleration that would otherwise significantly reduce the mass resolution.

The mass resolution of a TOF mass spectrometer depends on the ability to measure the drift time of ions with high precision. One way to achieve this precision is to ensure that all ions have low initial velocities and are spatially localized in a small region at the initial time. An ion trap can be used to achieve this initial condition by trapping and cooling sample ions until the initial time, at which time all ions are released together. Cooling the ions lowers the velocity of the ions. An additional advantage is that ions can be accumulated in the trap between extraction pulses so that the number of ions detected at a given time will be higher, thus increasing sensitivity.

Ion mobility spectrometry (IMS) is another form of chemical analysis that is similar to TOF mass spectrometry, but identifies chemical species based on drift time through a drift channel. The mechanical arrangement for IMS is about the same as in TOF. Ions start at t=0 in a confined region, then are allowed to drift through a constant field region to a detector, with an arrival time inversely proportional to the ion mobility. As with TOF, measurement resolution is improved by spatially localizing the ions in a small region at the initial time.

IMS is performed at higher pressure, even atmospheric pressure, versus a high vacuum for TOF-mass spectrometry. The gas that is present in IMS causes a viscous drag on the ions so it is necessary to have an electric field in the drift region. In practice, the drift and acceleration regions are generally merged into one drift channel. The ions move through the drift region with a velocity that is proportional to the electric field. The proportionality constant is characteristic of the ion but not quite as informative as the mass. Also, the resolution is degraded because of the diffusion that takes place during the drift.

In addition, in IMS the ion velocity is proportional to the applied field, whereas in TOF-mass spectrometry the ion acceleration is proportional to the applied field. IMS has a wide variety of applications currently because it does not require a vacuum system and is the method generally used in airports to test baggage for explosives and drugs, and also by the military for CW detection.

U.S. Pat. No. 6,469,298 to Ramsey et al., entitled "MICROSCALE ION TRAP MASS SPECTROMETER" discloses miniature ion traps including submillimeter traps having improved spectral resolution over earlier small ion traps for mass spectrometry chemical analysis. U.S. patent application Ser. No. 10/801,913 to Whitten et al. entitled "ION TRAP ARRAY-BASED SYSTEMS AND METHODS FOR CHEMICAL ANALYSIS" discloses related ion-trap arrays and is published as 6,933,498 on Aug. 23, 2005. The ion traps disclosed in these references can each have an effective radius $r_0$ and an effective length $2z_0$, wherein at least one of $r_0$ and $z_0$ are less than 1.0 mm, and a ratio $z_0/r_0$ is greater than 0.83. Both $r_0$ and $z_0$ can be less than 1.0 mm. Miniature ion traps allow for the creation of field portable mass spectrometers. However, such devices currently have limited application because translationally hot ions provided by conventional ion sources, such as electrospray or laser ablation and matrix-assisted laser desorption ionization (MALDI), are far too energetic to be trapped in the trap(s). As a result, ions in such systems can only be created with the trap. Consequently, such instruments are generally limited to only electron impact of small volatile organic molecules and gas phase testing.

SUMMARY OF THE INVENTION

An ion trap mass spectrometry system adapted for portability includes an ion source for generating ions from a sample to be analyzed, and a resistive drift tube coupled to an output of the ion source for receiving the ions injected therein. The resistive drift tube decelerates the ions to provide cooled ions having a mean translational kinetic energy of less than 5 keV. A miniature ion trap or trap array, such having apertures <5 mm, is coupled to an output of the resistive drift tube for trapping the cooled ions. A spectrometer is coupled to the miniature ion trap for analyzing the cooled ions. In one embodiment, the miniature ion trap provides apertures <1 mm. The voltage across the resistive drift tube is generally <100 Volts, such as <10 Volts.

The spectrometer can be a time-of-flight mass spectrometer or an ion mobility spectrometer. The inner diameter of the resistive drift tube can be <0.5 cm, such as <0.1 cm. The ion source can be selected from electrospray, laser ablation, MALDI, field emitting array, or an electron impact (EI) ionization source.

A method of controlling translational ion kinetic energy, comprises the steps of providing a resistive drift tube coupled to an ion trap or ion trap array, injecting ions generated by an ion source spaced apart from the resistive drift tube into the resistive drift tube, wherein the ions are decelerated while in the resistive drift tube to provide cooled ions having mean translational kinetic energies less than 5 keV. The cooled ions are then injected into the ion trap or ion trap array. The method can further comprise the step of controlling the average translational kinetic energy using at least one of pressure in the resistive drift tube and the applied field in the resistive drift tube. The method can generally includes the step of injecting the cooled ions in the ion trap or ion trap array into a spectrometer, such as a time-of-flight mass spectrometer or an ion mobility spectrometer.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE INVENTION

An ion trap mass spectrometer includes a translational kinetic energy controlled ion source adapted for field portability which comprises an ion source coupled to a resistive drift tube. The resistive drift tube is operated in an ion cooling mode where the translational kinetic energy of ions injected from the ion source are decelerated (cooled) to have mean translational kinetic energies less than 5 keV, and preferably less than 1 keV, most preferably less than 500 eV, such as <100 eV or <20 eV. The resistive drift tube is coupled to a miniature ion trap. The applied voltages across the resistive tube is generally in the range from 1 to 300 V to obtain the desired mean translational kinetic ion energy. In comparison, drift tubes are generally operated with voltages across the tube of 500 to 1,000 V, or more, and are operated to separate ions based on their collision cross-section.

As used herein, the term "resistive" drift tubes refer to a drift tube which includes at least a surface which eliminates or at least significantly reduces wall changing caused by incident ions hitting the surface of the tube. The resistive surface also eliminates the need for resistor chains in prior drift tube designs and inherently produces a more uniform electric field.

Figure 1:
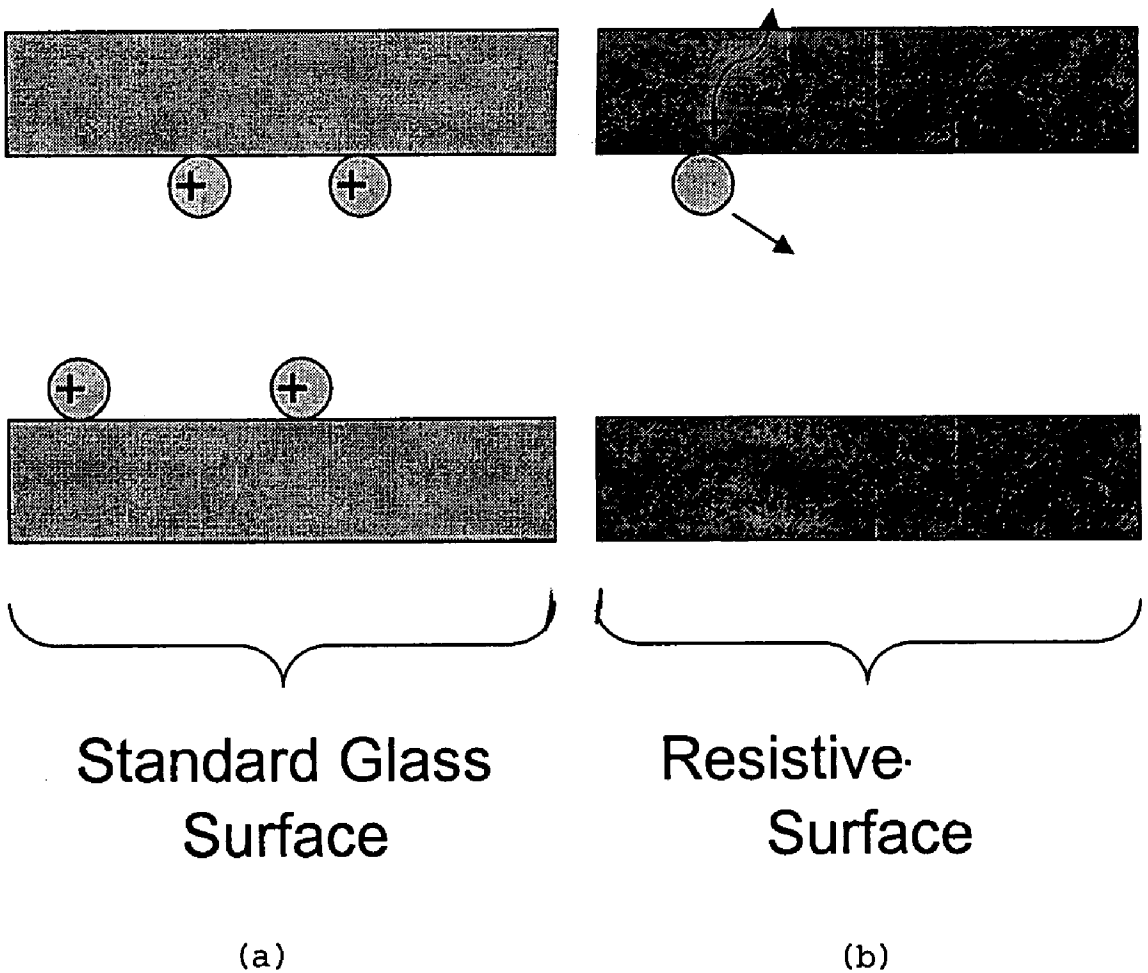
FIG. 1(*a*) is a depiction of wall charging on a standard glass (dielectric) surface as compared to (*b*) charge spreading of the induced charge using a resistive drift tube according to the invention. Wall charging is eliminated or substantially reduced by charge transfer across the semiconductor volume provided on the inner surface of the resistive drift tube.

Wall charging is a known problem with employing any small cross sectional area drift tubes due to the field generated when the tube surface charges due ion incidence. However, the use of a resistive drift tubes according to the invention eliminates or at least substantially reduces this problem by transferring the surface charge developed by ions incident thereon throughout the semiconducting volume provided by surface of the resistive tube. Charge transfer helps keep the continuity of the applied field in the tube substantially intact. FIG. 1(*a*) is a depiction of wall charging on a standard glass (dielectric) surface as compared to (*b*) charge spreading of the induced charge using a resistive drift tube according to the invention. Wall charging is eliminated or substantially reduced by charge transfer across the semiconductor volume provided on the inner surface of the resistive drift tube. As a result, narrow resistive tubes according to the invention can be used without significantly distorting the applied field in the tube, such as tubes having inner diameters of <1 cm, such as <0.5 cm, <0.3 cm, or <0.1 cm.

In a typical embodiment, the resistive drift tube includes at least a surface layer which is neither metallic nor electrically insulating. As defined herein, a resistive drift tube refers to a drift tube which provides at least a surface coating which provides a resistance in the range from $10^5$ to $10^{11}$ ohms, preferably being the range from $3\times10^7$ to $6\times10^8$ ohms. RESISTIVE GLASS™ is a suitable material available from Burle Electro-Optics (Sturbridge Mass.). RESISTIVE GLASS™ is composed of a proprietary lead silicate glass that has been doped to produce a resistive surface. RESISTIVE GLASS™ articles are formed and then heat treated to produce a semiconductive layer on the surface of the glass. The typical resistance range for drift tubes made from RESISTIVE GLASS™ is $10^5$-$10^{11}$ ohm. The resistive reduced lead silicate layer is typically a few hundred angstroms thick, and is disposed on electrically insulating bulk lead glass. The resistivity of the RESISTIVE GLASS™ tube can be varied over several orders of magnitude in order to optimize current flow and electric field strength. However, the invention is not limited to RESISTIVE GLASS™.

For example, alternatively, the resistive tubes can be formed from a semiconducting material or be coated with a layer of a semiconducting material. In another embodiment, tube 120 can be replaced by a tube made of a dielectric material having a pair of external electrodes sandwiching the tube, such as disclosed in U.S. Pat. No. to Hutchinson et al. entitled "Dielectric waveguide gas-filled stark shift modulator". In the detailed description accompanying FIG. 5, Hutchinson et al. teach using a high speed alternating frequency signal applied to the electrodes which switches polarity faster than the rate of charge build-up on the walls of the dielectric tube. As disclosed in Hutchinson et al., when an electrical field is applied to the external electrodes, free electrical charges, such as ions and electrons in certain dielectric materials, can migrate to the side of the dielectric nearest the electrodes. This aspect of Hutchinson et al. is incorporated by reference into the present application.

As defined herein, a "miniature ion trap" or "miniature trap array" comprises a trap or trap array including traps having <10 mm apertures, such as <5 mm, and preferably <1 mm. The translationally cooled ions are injected into the ion trap or ion trap array where they are trapped. The output of the ion trap or ion trap array is coupled to a spectrometer, such as mass spectrometer or ion mobility spectrometer. Systems according to the invention may include a plurality of tubes according to the invention in parallel tube arrangement for generation of higher ion current (not shown). Such an arrangement more efficiently transmits ions from ion sources, particularly when the ion source produces ion beams which tend to be diffuse.

The cooled ions provided by the resistive drift tube allows the miniature ion traps to trap ions. As noted in the background, because of the difficulty to trap translationally hot ions in miniature ion traps and related trap arrays, previous systems required ions be generated inside the traps. Such a requirement limits materials that can be analyzed, severely limiting ion source selection, and also effectively eliminates the possibility for portable spectroscopy systems. The invention solves these deficiencies of prior miniature trap comprising spectroscopy systems by using a resistive drift tube to cool externally formed ions for capture and analysis in a miniature ion trap, such as a portable <1 mm cylindrical ion trap. Regarding field portability, a typical system including an ion trap, sources, detectors, and vacuum system generally weighs less than 20 lbs (9 kgs). Such systems can be readily be carried by an individual, such as a soldier and include alarms triggered by detection of selected materials.

Figure 2:
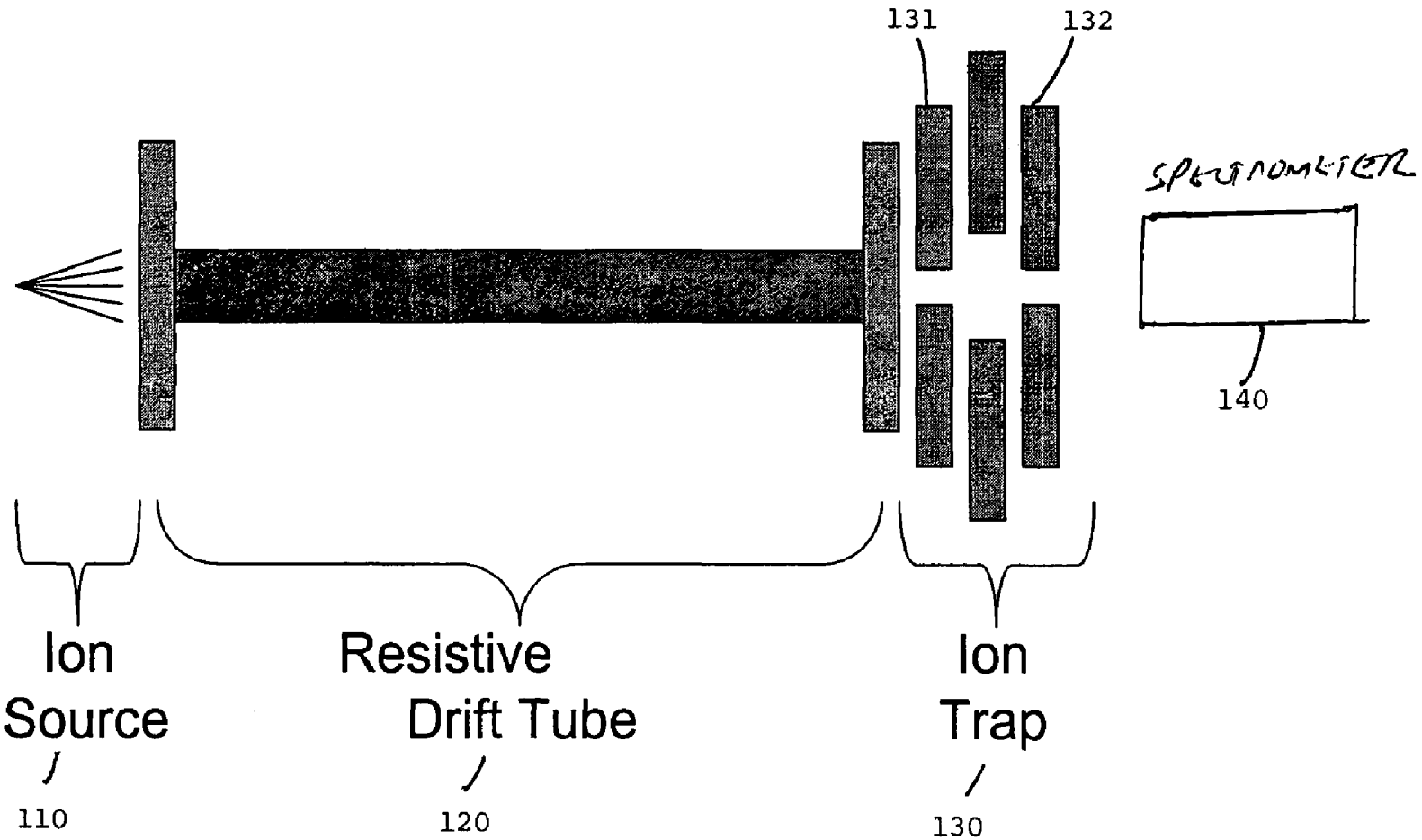
FIG. 2 is the schematic of a spectrometer according to an embodiment of the invention including an ion source coupled to a resistive drift tube, which is coupled to a miniature ion trap or ion trap array.

Ion sources according to the invention can be used for ion trap spectrometers which include miniature ion traps or trap arrays. Referring now to FIG. 2, the schematic of a spectrometer 100 according to an embodiment of the invention is shown. Spectrometer 100 includes an ion source 110 coupled to a resistive drift tube 120. Ion source can be an electrospray, laser ablation, MALDI, field emitting array, electron impact (EI), membrane inlet, and thermal desorption. As described above, the resistive drift tube 120 is operated in an ion cooling mode where the translational kinetic energy of ions injected from the ion source can be controllably decelerated (cooled) to have mean translational kinetic energies less than 5 keV, and preferably less than 1 keV. To produce the desired level of ion cooling, the drift tube is operated generally in the range of 1 to 100 V across the tube. Pressure in the drift tube 120 may also be used to control ion energy. Thus, translational energy control provided by system 100 is providable by varying the pressure and/or the applied field to the drift tube 120.

The resistive drift tube 120 is coupled to a miniature ion trap 130 which includes end cap electrodes 131 and 132. Without deceleration provided by the inventive drift tube 120, a large percentage of hot ions provided by ions source 110 will traverse both the potential barriers of the end caps 131 and 132 of the ion trap 130. Miniature ion trap 130 is coupled to a spectrometer 140, such as a TOF-MS or IMS.

Applied as an ion trap mass spectrometer, because of the nature of the vacuum needed for operation of the ion trap mass spectrometer, the drift tube will be commonly used at pressures below about 1 Torr. This leads to a large mean free path, increasing the diffusion of the ions. This somewhat degrades separation resolution, but allows for the desired substantially discrete translational energy profiles.

Applied as an ion trap ion mobility spectrometer, the spectrometer 140 shown in FIG. 140 will generally comprise another drift tube (operated as a drift tube) coupled to a faraday cup, to an electrometer, then to a timer (all IMS components not shown). Because of the nature of the vacuum needed for operation of the ion trap IMS, the drift tube will be commonly used at pressures of about 0.01 mTorr to atmospheric pressure.

The invention is expected to provide a wide range of applications. Ion sources according to the invention can be coupled to currently available miniature and portable mass spectrometers that express the need for small pumping hardware because the invention allows for externally generated ions to be injected into miniature mass spectrometers without putting excess gas load on the miniature vacuum pumps. Drift tubes according to the invention are compatible with a wide variety of ion sources, including electrospray, laser ablation, and MALDI. Use of such sources allows spectroscopy systems to analyze large molecules including biomolecules.

The invention is expected to significantly aid in homeland security. Non-limiting examples include ion trap mass spectrometers which include electrospray inlets for proteins and other biomolecules (biological weapons), membrane inlets for volatile organic compounds (explosives detection), direct sampling of atmospheric samples (nuclear), particle inlet systems for mass analysis of airborne particles, and atmospheric pressure chemical ionization of molecules that readily form negative ions.

The invention can be sold as an add-on source for retrofitting existing systems, or as a complete portable ion trap spectrometer system. As noted above, portable spectroscopy systems can be used for homeland security applications.

A method of chemical analysis includes the steps of generating a plurality of ions in an ion source, injecting the plurality of ions into a resistive tube according to the invention to cool the plurality of cooled ions. Once cooled, the cooled ions are injected into a miniature ion trap or trap array. The plurality of different species of ions are then simultaneously directed out from at least one of the ion traps, and the ions are then identified. The method can comprise time-of-flight mass spectrometry or ion mobility spectrometry for identification.

EXAMPLES

It should be understood that the Examples described below are provided for illustrative purposes only and do not in any way define the scope of the invention.

A mixture of $C_{60}$ (720 a.u.) and $C_{70}$ (840 a.u.) fullerite was deposited onto a probe tip. Laser ablation with a $N_2$ laser was employed to ionize the sample. The sample ions were collisionally cooled in a 2 inch long, 0.125 inch ID (0.3 cm), 0.150 OD, RESISTIVE GLASS™ drift tube at 1.0 Torr He. The translational kinetic energy was controlled by varying the pressure and the applied field to the drift tube. The cooled ions were trapped and analyzed using a 1 mm cylindrical ion trap coupled to a channeltron detector which was at $1.0\times10^{-4}$ Torr.

Figure 3:
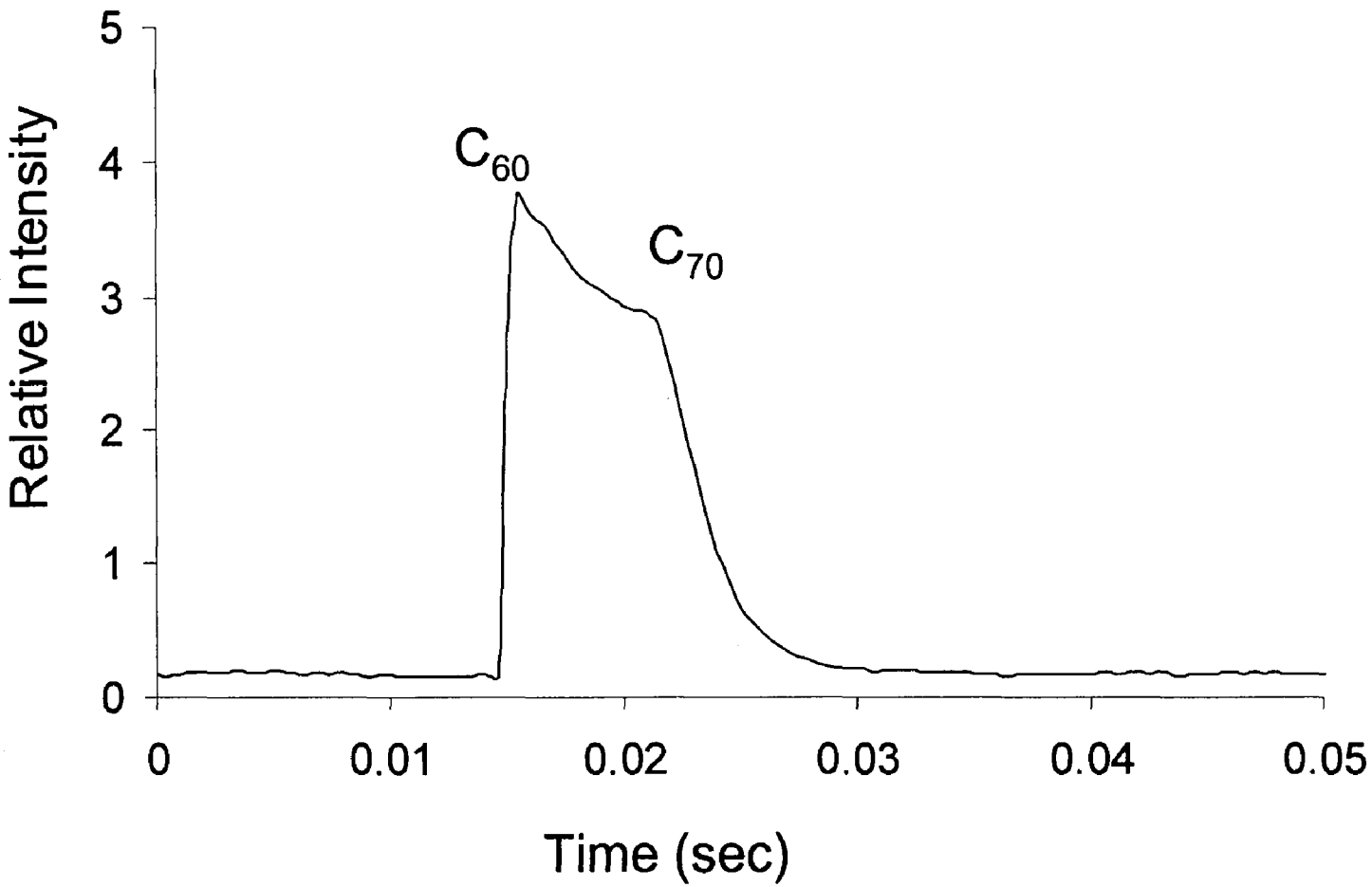
FIG. 3 shows the mass spectrum recorded by a channeltron detector using an ion source coupled to a resistive drift tube, which is coupled to a miniature ion trap. Peaks for $C_{60}$ (720 a.u.) and $C_{70}$ (840 a.u.) fullerite are both identified in FIG. 3.

FIG. 3 shows the spectrum recorded by the channeltron detector. Peaks for $C_{60}$ (720 a.u.) and $C_{70}$ (840 a.u.) fullerite were identified as shown in FIG. 3.

Figure 4:
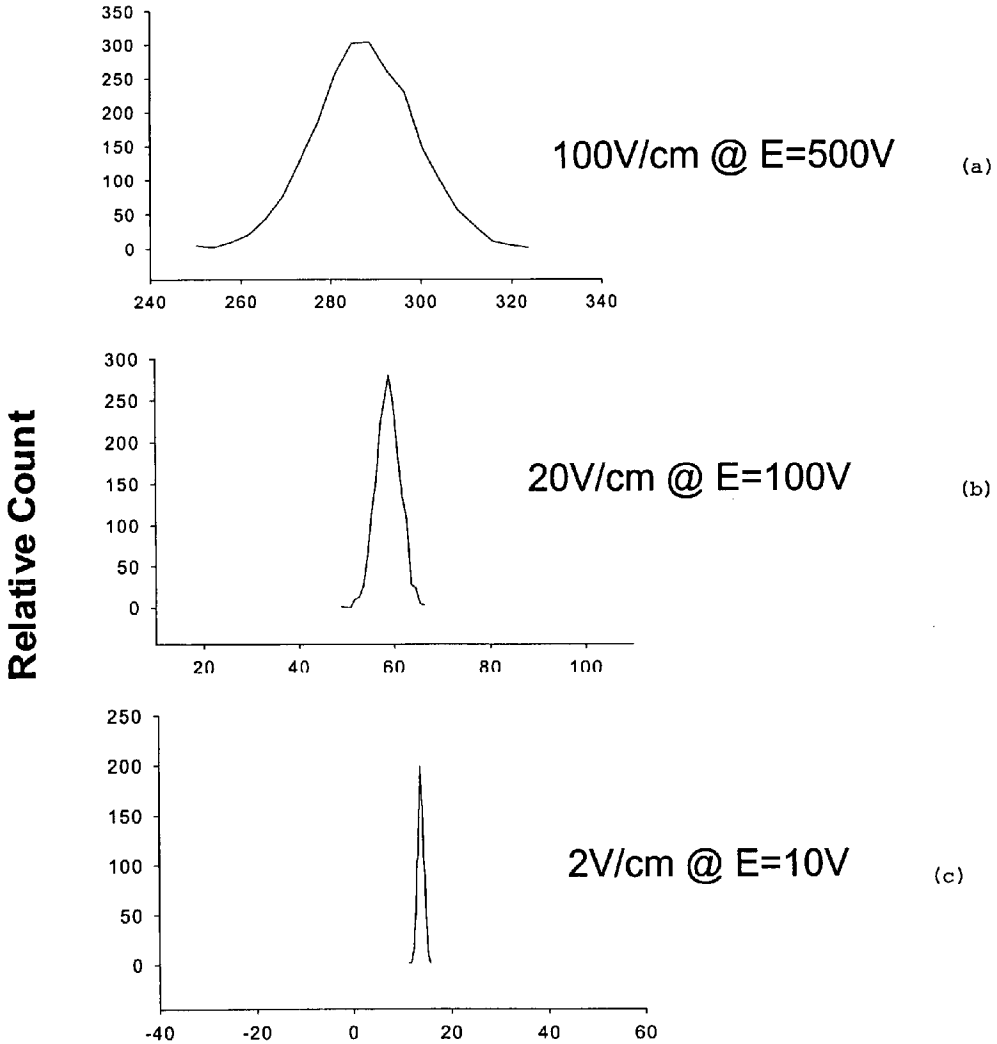
FIGS. 4(*a*)-(*c*) show results obtained for the resulting energy distribution in eV by varying the drift tube applied field at a pressure in the drift tube of 1 Torr.

FIGS. 4(*a*)-(*c*) show simulated results obtained for energy distribution in eV by varying the drift tube applied field holding the pressure in the drift tube at 1 Torr. As shown in FIG. 4(*a*), an average translation kinetic energy of about 285 eV was obtained using an applied voltage end-to-end potential difference of 500 V, thus generating an electric field in the drift tube of about 100 V/cm (2 inches=5 cm). FIG. 4(*b*) shows an obtained average translation kinetic energy of about 60 eV using an applied voltage end-to-end potential difference of 100 V (20 V/cm), while FIG. 4(*c*) shows an obtained average translation kinetic energy of about 18 eV using an applied voltage end-to-end potential difference of 10 V (20 V/cm).

Figure 5:
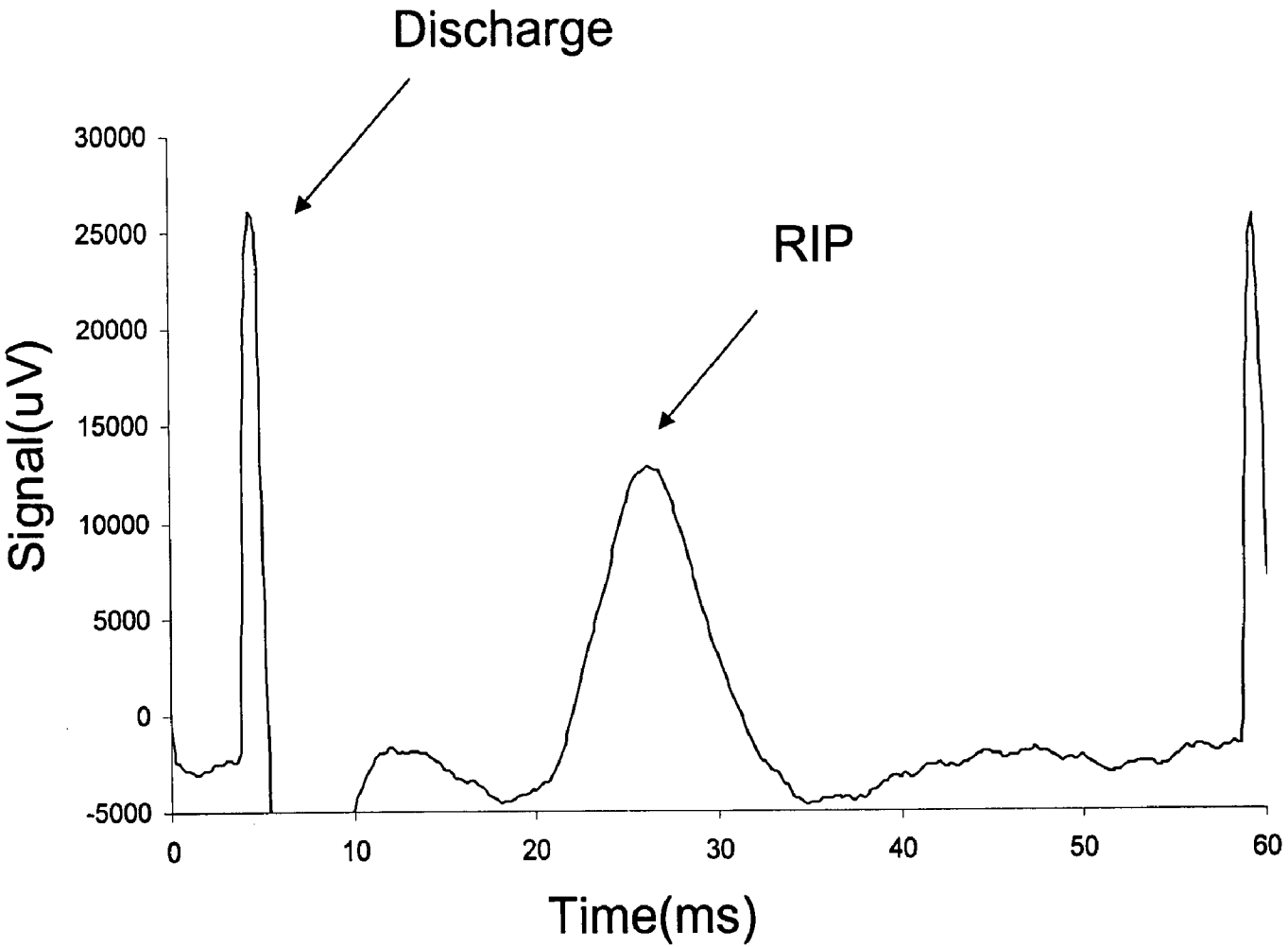
FIG. 5 shows ion mobility results from an IMS spectrometer according to the invention which comprised an ion source coupled to a resistive drift tube, coupled to a miniature ion trap.

As noted above, the invention can also be used in ion mobility spectrometry systems. FIG. 5 shows ion mobility data obtained from such as system. The ion mobility spectrum was obtained at atmospheric pressure. The sample ions (referred to as a residual ion peak, comprising nitrogen and oxygen clusters) generated from a discharge source were collisionally cooled in a 3 inch long, 0.125 inch ID, 0.150 OD, RESISTIVE GLASS™ drift tube at atmospheric pressure which was coupled to the IMS. The reactant ion peak (RIP) shown corresponds to negative charged nitrogen and oxygen clusters formed in the discharge.

This invention can be embodied in other specific forms without departing from the spirit or essential attributes thereof. Accordingly, reference should be had to the following claims, rather than to the foregoing specification, as indicating the scope of the invention.

We claim:

1. An ion trap mass spectrometry system, comprising:

an ion source for generating ions from a sample to be analyzed;

a resistive drift tube coupled to an output of said ion source for receiving said ions, said drift tube having a voltage applied along its length, wherein a resulting electric field decelerates said ions to provide cooled ions having a mean translational kinetic energy of less than 5 keV, and wherein an inner surface layer of said resistive drift tube comprises a semi-conductor devoid of both electrodes and electrically insulating materials and being operable to reduce distortions in said electric field within said drift tube by transferring surface charge away from said inner surface of said drift tube, said semi-conducting layer having a resistance between $10^5$ and $10^{11}$ ohms, wherein an inner diameter of said resistive drift tube is <0.5 cm;

a miniature ion trap coupled to an output of said resistive drift tube for trapping said cooled ions, wherein said miniature ion trap provides apertures <5 mm; and a time-of-flight spectrometer coupled to said miniature ion trap for analyzing said cooled ions, wherein said system applies a direct current, end-to-end voltage difference of 20V/cm or less across said resistive drift tube.

2. The system of claim 1, wherein said miniature ion trap provides apertures <1 mm.

3. The system of claim 1, wherein said system applies a direct current, end-to-end voltage difference of 2V/cm or less across said resistive drift tube.

4. The system of claim 1, wherein said inner diameter is <0.1 cm.

5. The system of claim 1, wherein said ion source is an electrospray, laser ablation, MALDI, field emitting array, or an electron impact (EI) ionization source.

6. A method of controlling translational ion kinetic energy, comprising the steps of:

providing a resistive drift tube, having an inner diameter <0.5 cm, coupled to an ion trap or ion trap array, said drift tube having an electric field applied along its length, and wherein an inner surface layer of said resistive drift tube comprises a semi-conductor and is devoid of both electrodes and electrically insulating materials and being operable to reduce distortions in said electric field within said drift tube by transferring surface charge away from said inner surface of said drift tube;

injecting ions generated by an ion source spaced apart from said resistive drift tube into said resistive drift tube, wherein said ions are decelerated by said applied field while in said resistive drift tube to provide cooled ions having mean translational kinetic energies less than 5 keV;

applying a direct current, end-to-end voltage difference of 20V/cm or less across said resistive drift tube during said injecting ions generated by an ion source step; and injecting said cooled ions into said ion trap or ion trap array, wherein said ion trap or ion trap array provides apertures <5 mm.

7. The method of claim 6, further comprising the step of controlling said average translational kinetic energy using a pressure in said resistive drift tube and said applied field in said resistive drift tube.

8. The method of claim 6, further comprising the step of injecting said cooled ions in said ion trap or ion trap array into a spectrometer.

9. The method of claim 8, wherein said spectrometer is a time-of-flight mass spectrometer or an ion mobility spectrometer.

10. The method of claim 6, wherein said ion source is an electrospray, laser ablation, MALDI, field emitting array, or an electron impact (EI) ionization source.

11. The method of claim 6, further comprising providing the semiconducting layer with a resistance between $10^5$ and $10^{11}$ ohms.

12. The method of claim 6, further comprising operating said resistive drift tube at a pressure of between 0.01 mTorr and atmospheric pressure.

13. The method of claim 6, wherein the semi-conducting layer comprises a doped lead silicate glass.

14. The system of claim 1, wherein the semi-conducting layer comprises a doped lead silicate glass.

15. The method of claim 6, further comprising:

applying a direct current, end-to-end voltage difference of 2V/cm or less across said resistive drift tube during said injecting ions generated by an ion source step.

16. The method of claim 6, further comprising:

operating said resistive drift tube at a pressure less than 1 Torr.

* * * * *